US006443876B1

(12) United States Patent
Huang

(10) Patent No.: US 6,443,876 B1
(45) Date of Patent: Sep. 3, 2002

(54) BELT POSITION DEVICE FOR WAIST EXERCISER

(76) Inventor: Yu-Tong Huang, No. 77, Yeon-Ann Road, Tainan City (TW)

( * ) Notice: Subject to any disclaimer, the term of this patent is extended or adjusted under 35 U.S.C. 154(b) by 0 days.

(21) Appl. No.: 09/824,025

(22) Filed: Apr. 3, 2001

(51) Int. Cl.[7] ..... A63B 22/02
(52) U.S. Cl. ..... 482/54; 482/43; 482/62
(58) Field of Search ..... 482/54, 43, 51, 482/62, 63, 148; 601/11, 23, 46, 79, 81, 71, 24, 26; 128/41, 63, 36

(56) References Cited

U.S. PATENT DOCUMENTS 3,921,625 A * 11/1975 Feather ..... 128/63
5,176,597 A * 1/1993 Bryne ..... 482/74
5,234,392 A * 8/1993 Clark ..... 482/54
5,704,880 A * 1/1998 Amatulle ..... 482/54
6,033,344 A * 3/2000 Trulaske et al. ..... 482/7
6,126,575 A * 10/2000 Wang ..... 482/54
6,146,315 A * 11/2000 Schonenberger ..... 482/69
6,152,854 A * 11/2000 Carmein ..... 482/4
6,217,487 B1 * 4/2001 Reinert ..... 482/54
6,264,584 B1 * 7/2001 Bass ..... 482/54
6,273,844 B1 * 8/2001 Kelsey et al. ..... 482/54

* cited by examiner

*Primary Examiner*—Jerome W. Donnelly
*Assistant Examiner*—Lori Baker Amerson
(74) *Attorney, Agent, or Firm*—Rosenberg, Klein & Lee

(57) ABSTRACT

A waist exerciser includes a casing supported on two support posts and two blocks are rotatably connected to two ends of a shaft in the casing. A locking member is movably received in each of the blocks and has a plurality of first holes. Each of the blocks has a plurality of second holes which are located in alignment with the first holes. A belt has two ends which of which has a pin for inserting in the aligned first hole and second hole. Each of the pins has a groove and a periphery of the first hole is movably engaged with the groove so as to prevent the pin from disengaging from the holes.

2 Claims, 5 Drawing Sheets

BELT POSITION DEVICE FOR WAIST EXERCISER

FIELD OF THE INVENTION

The present invention relates to a waist exerciser which has a belt with two ends thereof connected to two blocks on two sides of the exerciser. Each of the blocks includes a locking plate to securely position the two ends of the belt.

BACKGROUND OF THE INVENTION

A conventional waist exerciser is shown in FIG. 6 and generally includes a post 8 on which a casing 5 is connected and a vibration mechanism 6 is received in the casing 5. Two connection disks 61 are connected to two ends of a shaft of the vibration mechanism 6 and two blocks 62 are connected to the two connection disks 61. Each of the blocks 62 has a plurality of holes 621 defined therein which are located at a respective distance from a center of the block 62. A belt 7 has two ends 63 each of which has a pin 631 which is inserted into one of the holes 621. A user stands on a pad 9 and the belt 7 contacts the user's waist. When the two blocks 62 are rotated and shake, the belt 7 massages the user's waist. However, the pins 631 on the two ends 63 of the belt 7 are not properly positioned in the holes 31, the pins 631 are simply inserted in the holes 31 so that the pins 631 could jump out from the holes 31 because of the vibration. The ends 63 will fly at a certain speed and hut the user.

The present invention intends to provide a safe device that securely holds the two pins in the two blocks.

SUMMARY OF THE INVENTION

In accordance with one aspect of the present invention, there is provided a waist exerciser and comprises a casing with a shaft rotatably received in the casing and two disks are connected to two ends of the shaft. Two blocks are respectively mounted to the disks and each block has a skirt portion and a notch is defined in each of the two skirt portions. A plurality of first holes are defined through each of the blocks. Two locking members are respectively received in the skirt portions of the two blocks and each of the locking members has a bent portion extending from a first end thereof. The bent portions are respectively located in the two notches and a spring is biased at a second end of each of the locking members. Each of the locking members has a plurality of second holes which are located in alignment with the first holes. A belt has two ends and each end has a pin extending therefrom. Each of the pin has a groove defined therein and each pin is inserted in the aligned first hole and the second hole. A periphery of the second hole is movably engaged with the groove.

The primary object of the present invention is to provide a waist exerciser that has locking members to hold the pins inserted in two blocks so that the pins will not loosen or be disengage from the blocks.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
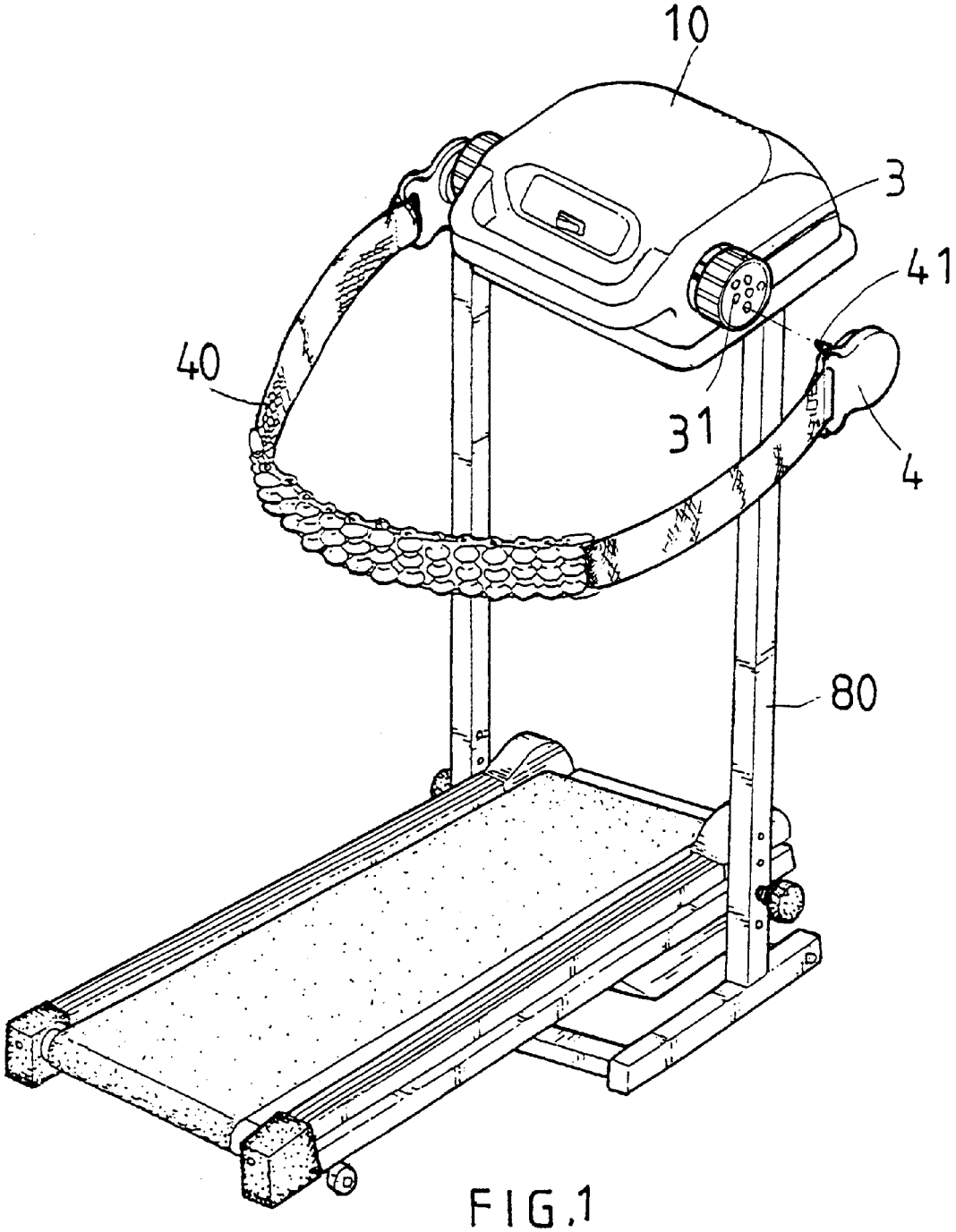
FIG. 1 is a perspective view to show the waist exerciser of the present invention.
Figure 2:
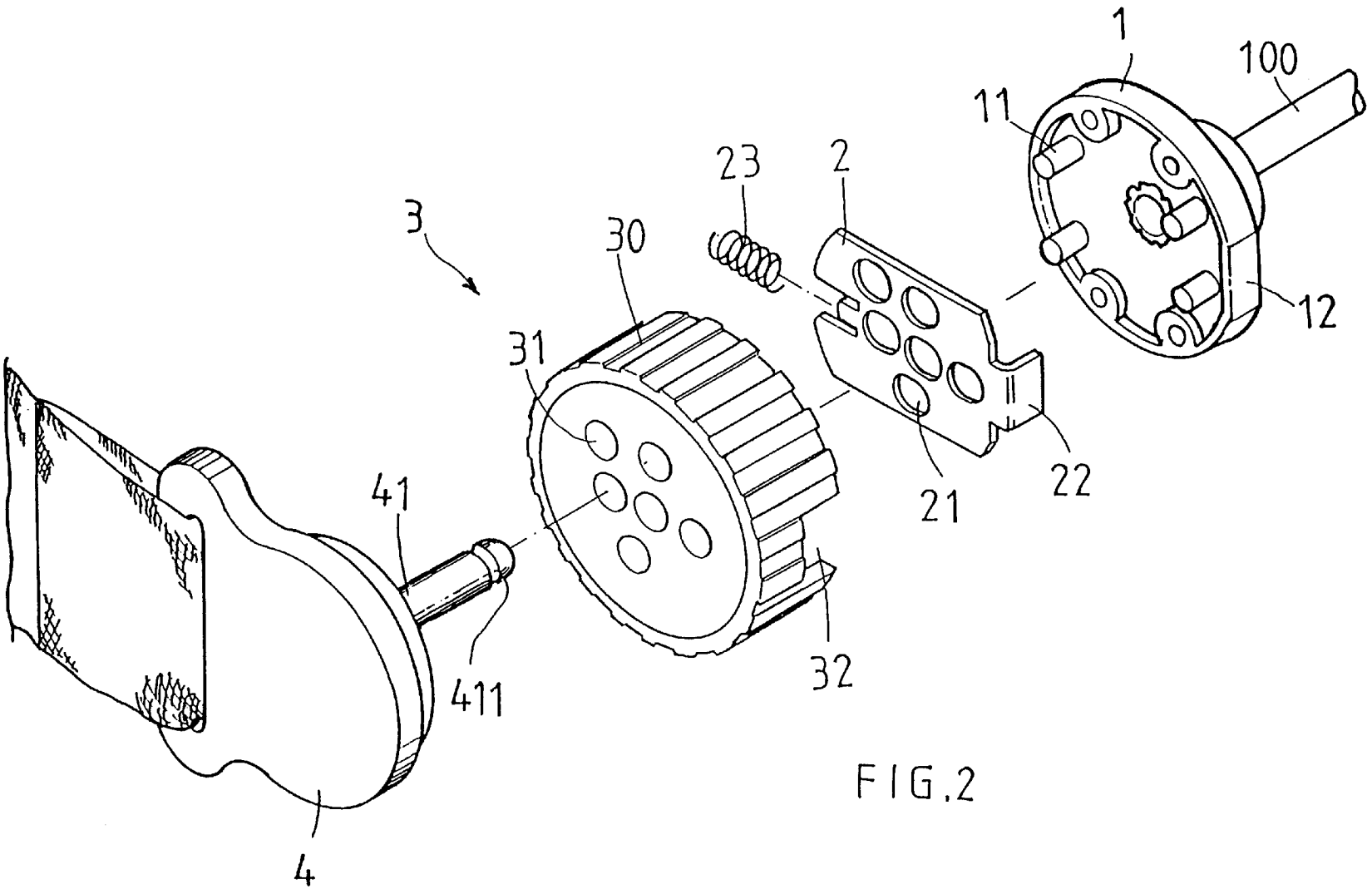
FIG. 2 is an exploded view to show a block, a locking member, a disk and a pin on the belt of the waist exerciser of the present invention.

Referring to FIGS. 1 and 2, the waist exerciser of the present invention comprises two support members 80 and a casing 10 is supported on the two support members 180. A shaft 100 is rotatably received in the casing 10 and two disks 1 are connected to two ends of the shaft 100. A flat surface 12 is defined in an outer periphery of each of the two disks 1. Two blocks 3 each have a skirt portion and a notch 32 is defined in each of the two skirt portions. The two blocks 3 are respectively mounted to the two disks 1 and the plan surface 12 of each of the two disks 1 is located in alignment with respective one of the two notches 32. A plurality of first holes 31 are defined through each of the blocks 3.

Figure 3:
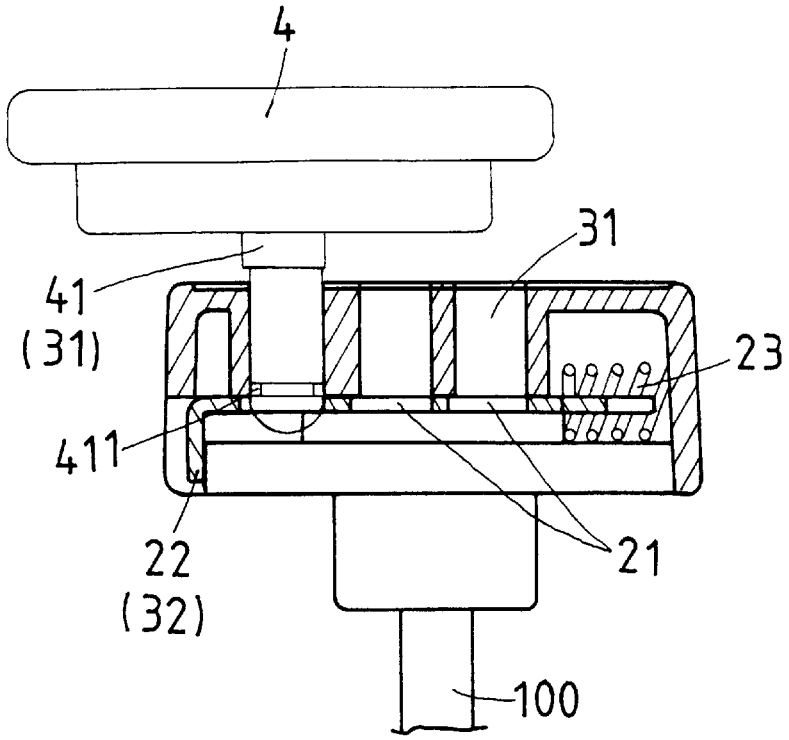
FIG. 3 is a cross sectional view to show the locking member is pushed to disengage the lock position of the pin.
Figure 4:
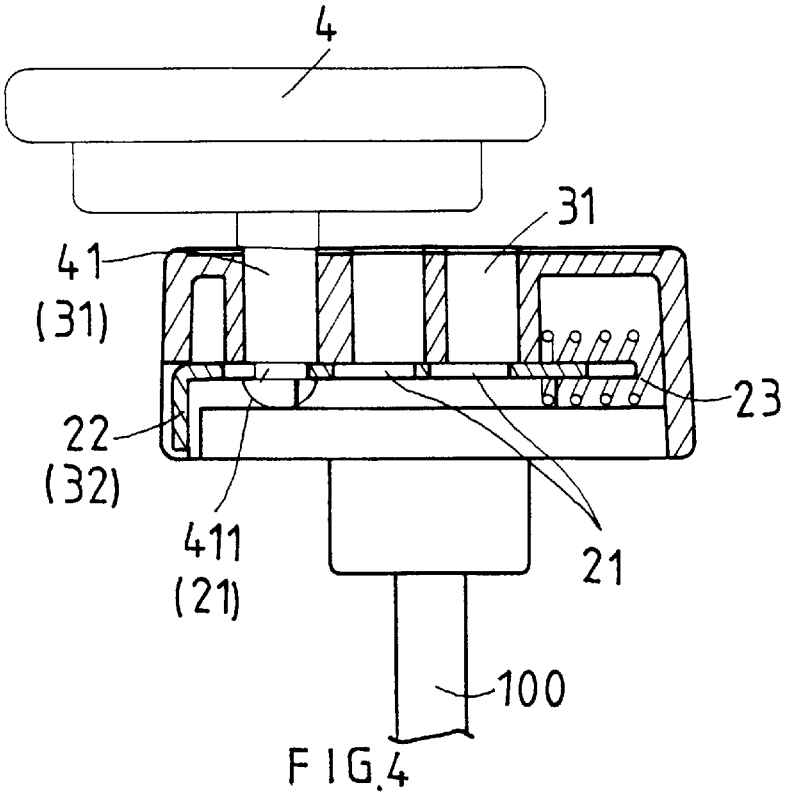
FIG. 4 is a cross sectional view to show the locking member locks the pin.

Further referring to FIGS. 3 and 4, two locking members 2 are respectively received in the skirt portions of the two blocks 3 and each of the locking members 2 has a bent portion 22 extending from a first end thereof. The bent portions 22 are respectively located in the two notches 32. A spring 23 is biased at a second end of each of the locking members 2. Each of the locking members 2 has a plurality of second holes 21 which are located in alignment with the first holes 31. Each of the two disks 1 has four rods 11 extending therefrom and the locking member 2 is retained between the four rods 11 as shown in FIG. 5.

A belt 40 has two ends 4 and each end 4 of the belt 40 has a pin 41 extending therefrom. Each of the pin 41 has a groove 411 defined therein and each pin 41 is inserted in the aligned first hole 31 and the second hole 21. As shown in FIG. 4, a periphery of the second hole 21 is movably engaged with the groove 411 so that the pins 41 will not be disengaged from the aligned holes 21, 31.

Figure 5:
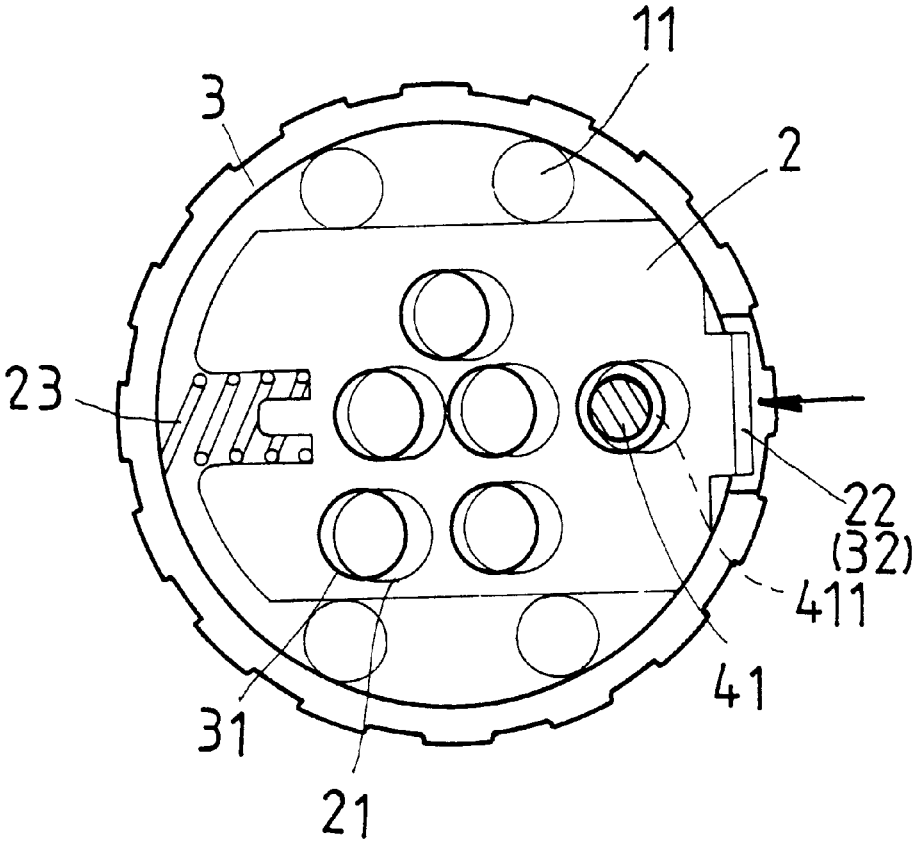
FIG. 5 is an end plan view to show the pin in the holes of the block and the locking member.
Figure 6:
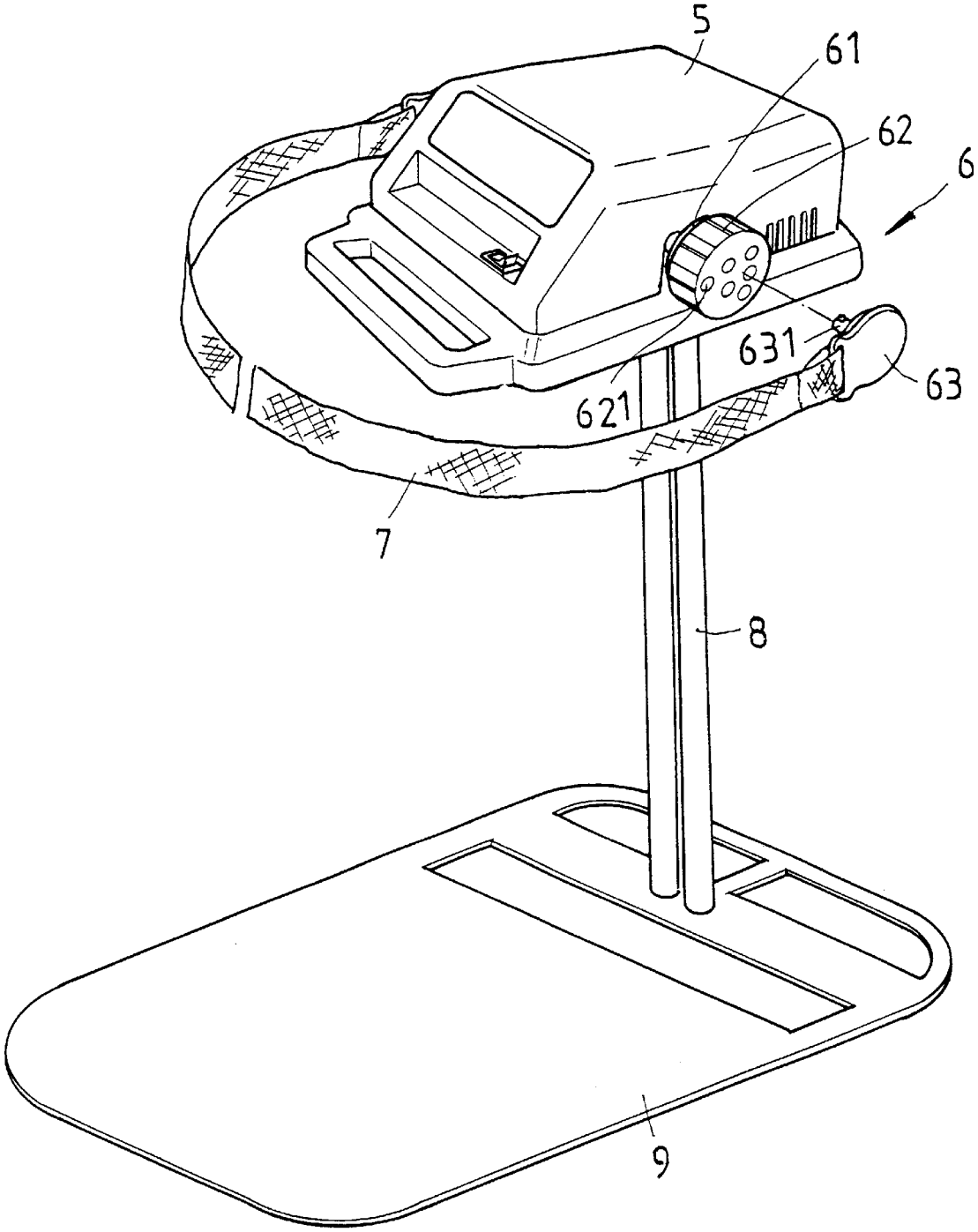
FIG. 6 is a perspective view to show a conventional waist exerciser.

As shown in FIGS. 3 and 5, when pushing the bent portion 22 toward the plan surface 12, the locking member 2 is moved and the periphery of the second hole 21 is disengaged from the groove 411 so that the pins 41 can be pulled out and inserted into another aligned holes 21, 31.

While we have shown and described various embodiments in accordance with the present invention, it should be clear to those skilled in the art that further embodiments may be made without departing from the scope of the present invention.

What is claimed is:

1. A waist exerciser comprising:

a support member connected to a casing and a shaft rotatably received in said casing, two disks connected to two ends of said shaft and each of said two disks having four rods extending therefrom, two blocks respectively mounted to said two disks and each block having a skirt portion and a notch defined in each of said two skirt portions, a plurality of first holes defined through each of said blocks;

two locking members respectively received in said skirt portions of said two blocks and said locking member being retained between said four rods, each of said locking members having a bent portion extending from a first end thereof; said bent portions respectively located in said two notches, a spring biased at a second end of each of said locking members, each of said locking members having a plurality of second holes which are located in alignment with said first holes, and a belt having two ends and each end of said belt having a pin extending therefrom, each of said pin having a groove defined therein and each pin inserted in said aligned first hole and said second hole, a periphery of said second hole movably engaged with said groove.

2. The waist exerciser as claimed in claim 1, wherein a flat surface is defined in an outer periphery of each of said two disks 1 and said plan surface of, each of said two disks is located in alignment with respective one of said two notches.

* * * * *